United States Patent [19]

Schupbach

[11] Patent Number: 4,837,826

[45] Date of Patent: Jun. 6, 1989

[54] STEREOPHONIC BAFFLE

[75] Inventor: Walter Schupbach, Prangins, Switzerland

[73] Assignee: SES Sound Electronic Systems S.A., Geneva, Switzerland

[21] Appl. No.: 38,534

[22] Filed: Apr. 14, 1987

[30] Foreign Application Priority Data

Jun. 5, 1986 [CH] Switzerland ..... 02282/86

[51] Int. Cl.[4] ..... H04R 5/02

[52] U.S. Cl. ..... 381/24; 381/89; 381/90; 381/205; 181/145

[58] Field of Search ..... 381/24, 88, 89, 90, 381/205; 181/145

[56] References Cited

U.S. PATENT DOCUMENTS

| | | | |
|---|---|---|---|
| 3,241,631 | 3/1966 | Manieri | 381/24 |
| 3,947,635 | 3/1976 | Frankman | 381/24 |
| 4,051,919 | 10/1977 | Buettner | 381/24 |
| 4,054,750 | 10/1977 | Montgomery et al. | 381/24 |
| 4,249,037 | 2/1981 | Dexter | 381/24 |
| 4,256,922 | 3/1981 | Görike | 381/24 |
| 4,267,405 | 5/1981 | Russell | 381/24 |
| 4,503,553 | 3/1985 | Davis | 381/24 |
| 4,572,325 | 2/1986 | Schupbach . | |

OTHER PUBLICATIONS

Feldman, Popular Science, "Sit-Anywhere Stereo", Aug. 1985, pp. 74, 75.

*Primary Examiner*—Forester W. Isen
*Attorney, Agent, or Firm*—Young & Thompson

[57] ABSTRACT

A stereophonic baffle comprises a first transducer group (7 to 10) located along a first line and fed by a right signal of a Hi-Fi chain and a second group of transducers (11 and 15) located according to a second line, forming an angle with the first line, and fed by a left signal. The left and right signals feeding the groups of transducers (7 and 10 and 11 to 15) are in phase and the path (a to e) separating the active zones of the two associated transducers (6,11; 7,12; 8,13; 9,14; 10,15) is equal to an odd multiple of the half wave length of a frequency comprised between 300 and 1000 Hz thus creating an acoustic coupling for the frequency, between the two transducers. The coupling frequencies of the different transducer couples are different.

8 Claims, 3 Drawing Sheets

FIG. 4
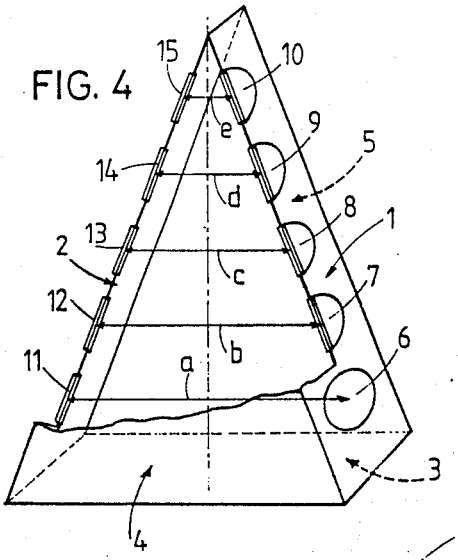
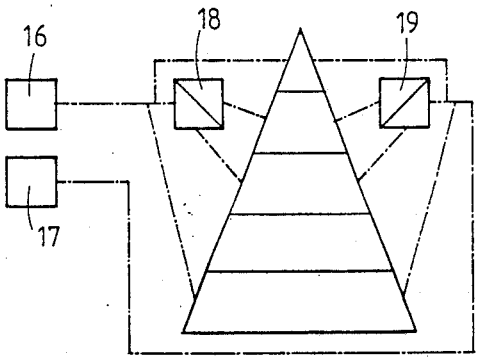
FIG. 5
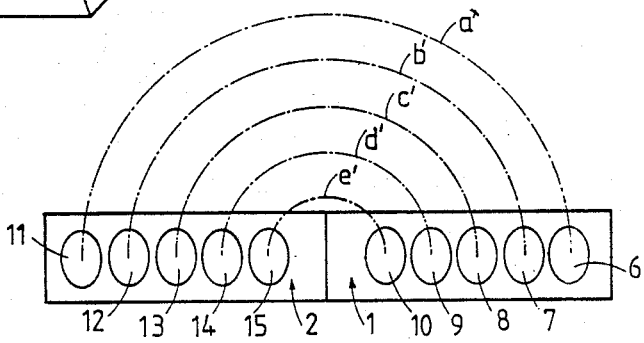
FIG. 6
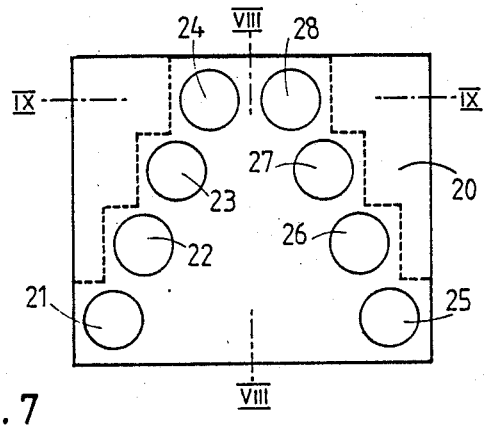
FIG. 7
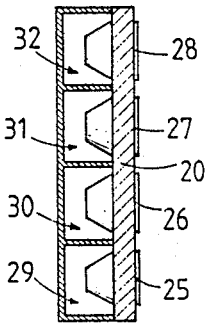
FIG. 8
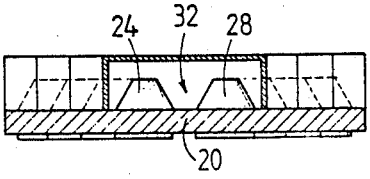
FIG. 9

STEREOPHONIC BAFFLE

BACKGROUND OF THE INVENTION

Monolithic stereophonic baffles are known such as the one described for example in U.S. Pat. No. *A*-4,572,325. Such baffles enable by means of a monolithic device, that is to say, a device which does not comprise two sound restitution columns, but only one, a better restitution of the sound space, or acoustical ambiance than the traditional devices having two baffles. Particularly these monolithic baffles enable an excellent localization of the sound by the listeners, that is a stereophonic restitution of the sounds, which is practically independant from the position of the listener with respect to the baffle, while this is not the case when the sound restitution is made by two separate baffles of columns.

The drawback of these existing monolithic baffles resides in the fact that they exclusively work in reflection, which means that they emit sonic waves in the direction of a wall which sends them back toward the listening space. This is in fact a drawback since on the one hand all the listening rooms are not adequate for the reflective listening (one has to have a bare wall) and on the other hand the quality of the restitution is influenced by the nature of the reflective wall, its texture, hardness, rugosity, module of elasticity and so on as well as by the distance separating this reflective wall from the monolithic baffle.

The present invention has for aim the realization of a monolithic stereophonic baffle which obviates the precited drawbacks while keeping the advantages relative to the quality of the sound restitution obtained by the baffles described in the aforementioned U.S. patent.

SUMMARY OF THE INVENTION

The present invention has for its object a monolithic stereophonic baffle comprising a first group of transducers disposed along a first line and fed by all or part of the "right" signal of an amplifier a Hi-Fi chain as well as a second group of transducers disposed along a second line, forming an angle with the first line, and fed by a "left" signal of the amplifier, characterized by the fact that the first and second groups comprise the same number of transducers, by the fact that the "right" signals and the "left" signals feeding the groups of tranducers are in phase, by the fact that the path separating the active zones of two associated transducers, each belonging to one of said the groups, is substantially equal to an odd multiple of the half wave length of a frequency comprised between 300 and 1000 Hz creating thus an acoustic coupling for the frequency between these two associated transducers, and by the fact that the coupling frequencies of the different couples of transducers are different.

BRIEF DESCRIPTION OF THE FIGURES

The attached drawing shows schematically and by way of example the human localization modes for sound sources as well as different embodiments and variants of the sound baffle according to the invention.

FIGS. 4 to 6 show three variants of a first embodiment of the baffle according to the invention.

FIGS. 7 to 9 show a second embodiment of the baffle according to the invention.

FIGS. 15 and 16 show additional embodiments of the invention.

DETAILED DESCRIPTION

Recent studies mainly empirical, enable one to get near to the physiology of the human listening particularly in the field of the localization of received sounds, noises and so on.

Figure 1:
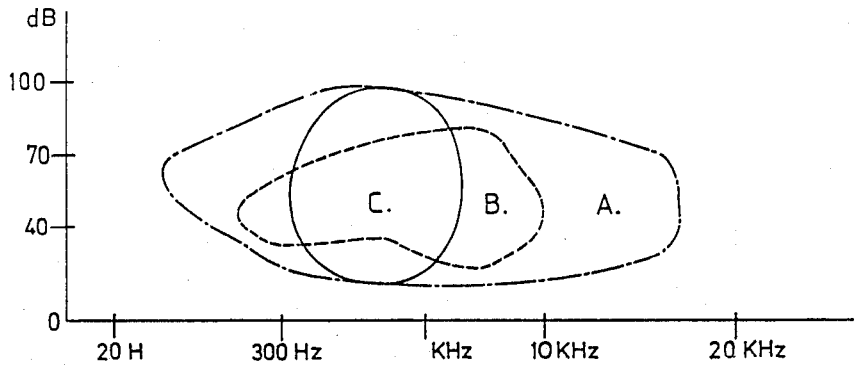
FIG. 1 is a diagram showing the human sonic perception zones of the music and of the speaking in function of the sonic intensity and of the frequency of the sound as well as of the zone in which the localization of a sonic source is possible.
Figure 2:
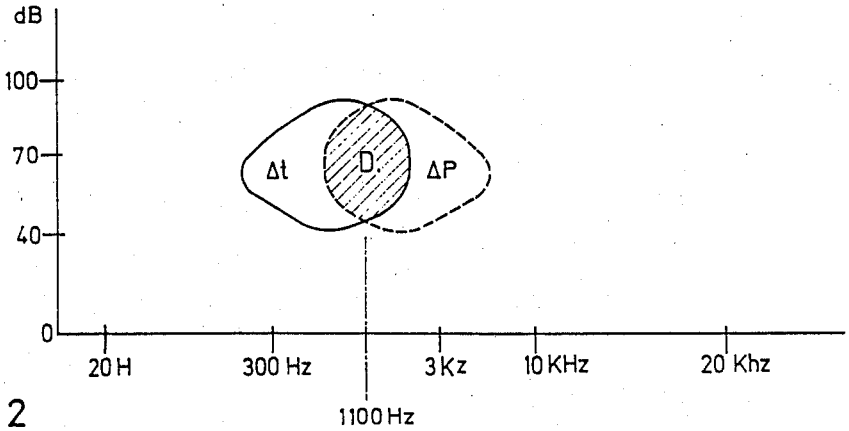
FIG. 2 is a diagram showing in function of the sonic intensity and of the frequency of the sound the zones in which the localization of the sonic source is made by the time differential respectively, the sonic intensity differential between the active part of an ear and of the other.
Figure 3:
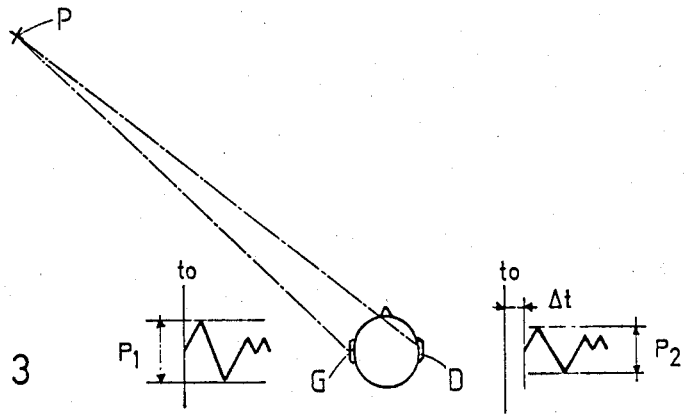
FIG. 3 shows the sonic signals received by the left and right ears of a listener coming from a source located in front and on its left.

From these studies, some constatations which are shown at FIGS. 1 to 3 can be put forward. FIG. 1 shows that the human ear is sensible for the perception of music in a range A from about 20 Hz to 20 KHZ for an intensity of 20 to 90 dB. For the speaking the human ear is sensible in a zone B which is more restrictive and it is only for the zone coming from the field C 300 Hz to 5 KHz; 40 dB to 70 dB, restricted, which the person listening is capable of localizing from where the sounds comes.

This localization is done thanks to two parameters, on the one hande the time differential $\Delta t$ separating the perception of a same wave from by the left and right ear and on the other hand the sound pressure differential $\Delta p$ of a front wave between the two ears. FIG. 2 shows that the two parameters $\Delta t$ and $\Delta p$ enabling the localization of a sound, are used in practically equivalent manner in the zone D centered around 1100 Hz, above this frequency it is the sound pressure differential $\Delta p$ which is predominant, whereas below this frequency it is the time differential $\Delta$ t which predominant for the localization of a sound.

FIG. 3 shows the perception by the left ear G and by the right ear D of a listener of a sound, audible front-waves coming from the point P. If the left ear G receives the sound at time to with an intensity of P1, the right ear D receives the sound at time (to $+\Delta$ t) and with an intensity or sonic pressure ($P2=P1-\Delta P$).

On the basic of these constatations which the applicant has experimentaly put in evidence, it is deduced that to enable stereophonic listening coming near to the real listening conditions, it is necessary that the restriction device of the sound permits practically in all part of a listening room to realize, for frequencies comprised between 300 Hz and 4 HKz and acoustical pressures comprised between 40 dB and 90 dB, through the combination of the left and right signals coming from distinct sources but localized in only one stereophonic baffle, the reproduction of the parameters $\Delta t$ and $\Delta p$ such as they would be produced during a direct listening of sounds coming from sources having different positions with respect to the listener.

This may be realized by recording the left and right signals by means of a listening head composed of two microphones separated by the mean distance separating the two ears of a person, then in feeding these left-right signals, for the frequency range from 300 Hz to 40 Khz at least, to a plurality of couples of loud-speakers, each of these couples of loud-speakers being acoustically coupled for a different frequency. Furthermore, the couples of loud-speakers are preferably disposed one with respect to the others in such a manner as to create a continuous front of waves, taking into account the different coupling frequencies.

In this way one can restitute for a listener located nearly everywhere in the listening room the parameters permitting the localization of sounds such as they would have been received by a direct listener located at the center of the listening room.

The first embodiment of the monolithic stereophonic baffle according to the invention responding to the above named criteria is shown in perspective at FIG. 4. It comprises a baffle presenting the shape of a transversal cross section of a prism having in cross section the shape of an isocelestriangle the base of which is formed by its small side.

The two other sides 1, 2 serve as support for loud-speaker groups each affected to one channel, right or left, each of these groups presenting the same number of loud-speakers. These two sides 1, 2 and the base 3 of this baffle are connected by frontal 4 and rear 5 walls forming thus a closed baffle.

Each loud-speaker 6,7,8,9,10 of a group is associated with a loud-speaker 11,12,13,14,15 of the second group to form a couple of loud-speakers separated by a different distance from one couple to the other permitting realization of an acoustical coupling of each of these couples to a different frequency. In the example shown, the couple of loud-speakers 6,11 is separated by a distance corresponding to the half wave length of a frequency of 300 Hz. The distances b, c, d and e separating the loud-speakers of the other couples correspond respectively to the half wave length of frequencies of 450, 650, 950 and 2000 Hz.

One thus realizes for these loud-speaker couples acoustical couplings for well-determined frequencies staggered between 200 Hz and 3 KHz, that is in the necessary range of frequencies for the localization of the sound.

It is evident that the response characteristics of the loud-speakers of different couples can be identical of different. In the later case, the loud-speaker couple 6,11 is more particularly adapted for the restitution of low frequencies, whereas the couple 10,15 is more particularly adapted for the restitution of high frequencies.

The quality of the sound restitution depends greatly on the quality of the loud-speakers, whereas the spatiality or sonic ambiance (incorporating the localization of the sounds) depends mainly on the coupling between the loud-speakers of the different couples covering the frequency range comprised between 300 and 1000 Hz ($\Delta t$).

Figure 10:
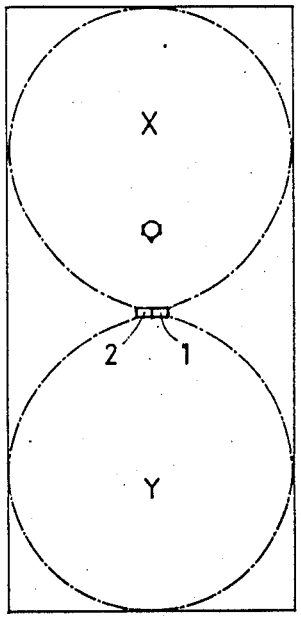
FIG. 10 shows the stereophonic listening zones of the devices shown at FIGS. 4 to 6.

Such a monolithic stereophonic baffle can be placed in the middle of a listening room and generates a stereophonic listening of good quality in zones X, Y such as the ones shown at FIG. 10.

FIG. 5 shows a variant of this first embodiment in which the loud-speakers of certain couples at least are fed by left 16 and right 17 amplifiers through band-pass filters 18, 19 selecting for each of the couples of loud-speakers thus fed a different frequency passing band. The passing band affected to a couple of loud-speakers will be closed to the frequency corresponding to the half wave length separating the loud-speakers so that this feeding mode reinforces further the acoustical coupling and thus the spatiality effect of the sound restitution. It is to be noted that the effect of localization depends mainly on the wave fronts of a frequency comprised between 300 Hz and 1 KHz and of the difference of pressure $\Delta p$ between 1000 and 4000 Hz and that this localization is very rapidly done, during the first millisecond, whereas the quality of the musical transmission depends on a much broader scale of frequencies from 20 Hz to 20 KHz and is recognized by the human brain during a time interval from 1 to 3 seconds. It is thus in practice quite possible to distinguish between the means permitting the localization of the sound from the ones permitting the perfect restitution of the sounds (music, noises and so on).

In the embodiment shown at FIG. 6, the acoustical coupling of the loud-speakers belonging to a given couple is not made by the distances a . . . e separating them through the inside of the baffle as previously but due to the fact that the length of the half circumference a' . . . e' corresponding to the length of a wave front separating them by the outside of the baffle, if one considers a spherical propagation of the sonic waves, is equal to an odd multiple of the half wave length corresponding to the desired coupling frequency. One obtains here a coupling which is outside of the baffle. In another embodiment one can imagine to realize a baffle in which an inside as well as an outside coupling would be realized.

In an embodiment such as the one shown at FIG. 6 the wave fronts caused by different couples of loud-speakers are not synchronized to the detriment of the localization as well as to the fidelity of the musical restitution. To obviate this drawback one can, be means of delay lines incorporated into the feeding of the electrical signals of the loud-speaker couples, cause a different time delay for each couple of loud-speakers of these signals so that in the symmetric plan of the baffle the wave fronts a' . . . e' are synchronised that is to say that in this plan all the wave fronts present a maximum at a given time. This coherence of the sound is very particularly important for the localization function so that it is possible to limit this sychronization to the couples of loud-speakers tuned on the frequencies comprised between 300 and 1000 Hz. See FIG. 15, where each couple has a different delay, $D_1$, $D_2$, or $D_3$.

In the embodiment shown at FIGS. 7 to 9, the baffle comprises a plan baffle 20 on which are fixed groups of loud-speakers 21, 22, 23, 24 and 25, 26, 27, 28 located along two lines forming an angle between them.

The rear wall of the baffle is provided with tuning chambers 29, 30, 31, 32 connecting the loud-speakers of the two groups forming the couples 21–25; 22–26; 23–27 and 24–28. The dimensions of these tuning chambers are such that they constitute for the given frequencies staggered between 300 Hz and 1 KHz, for example for 350 Hz, 450 Hz, 650 Hz and 950 Hz, resonators permitting a coupling for these frequencies of the corresponding loud-speaker couples.

This coupling permits again to ensure the diffusion, for the frequencies concerned the left and right signals with time delays Δt and acoustical pressure differential Δ p which are able to give perfect perception of the localization of the sounds and therefore to realize a perfect spatiality of the sonic diffusion of the baffle.

Figure 11:
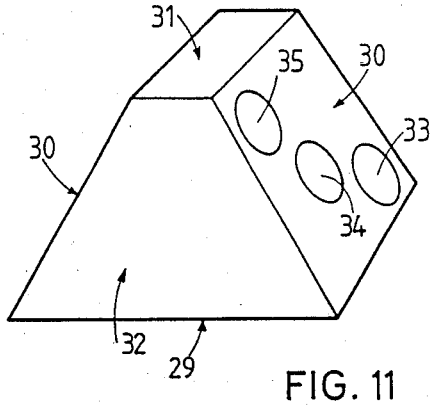
FIGS. 11 and 12 show a third embodiment of the baffle according to the invention.
Figure 12:
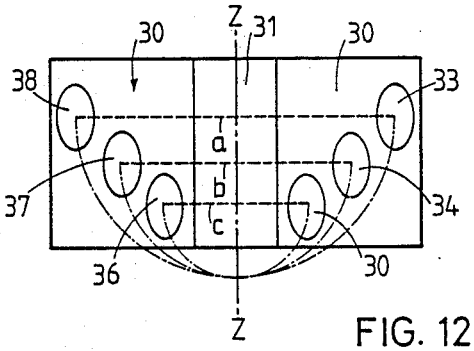

FIGS. 11 and 12 show a third embodiment of the monolithic stereophonic baffle formed of a base 29, of two baffles 30 and of a top 31 as well as of two end walls 32.

Each of the baffles 30 serves as support to a group of loud-speakers 33,34,35,36,37,38 forming the couples 33–36, 34–37 and 35–38.

In this embodiment one realizes as previously a coupling between the loud-speakers of a same couple to a given frequency (comprised between 300 Hz and 1 KHz) different for each loud-speaker couple in making the distances a, b, c equal to the half wave length corresponding to the desired coupling frequency.

Furthermore the localization of the loud-speakers of each group, not only displaced in height but also in depth, enables one to arrange that in the median plan Z-Z of the baffle the sounds, corresponding to frequencies for which the loud-speaker couples are tuned, emitted at a same time, make a common wave front which enhances further the quality of the sonic reception and of the localization faculties.

Figure 13:
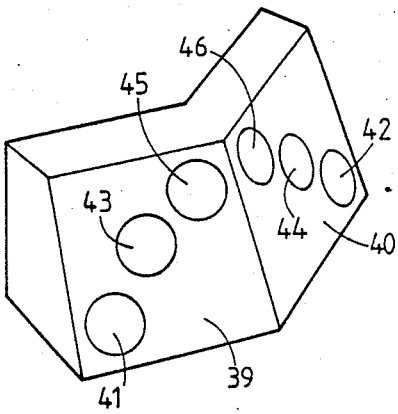
FIG. 13 shows a fourth embodiment of the baffle according to the invention.

In the embodiment shown at FIG. 13, the baffle comprises two frontal baffles 39, 40 inclined toward the rear and forming an angle between them. The baffle is obtained by a base, an upper wall, a rear wall and lateral walls. Groups of loud-speakers are fixed in each of the baffles 39, 40 and are located so as to form couples 41–42, 43–44, 45–46. An internal or external coupling is realized for determined frequencies between 300 Hz and 1 KHz, between the loud-speakers of a same couple to ensure a good restitution of the parameters defining the localization of the sounds. Further, the groups of loud-speakers are located on the baffle along curves so that or the tuning frequencies the sonic fronts of the couples of loud-speakers are all located in the median symmetric plan of the baffle.

Figure 14:
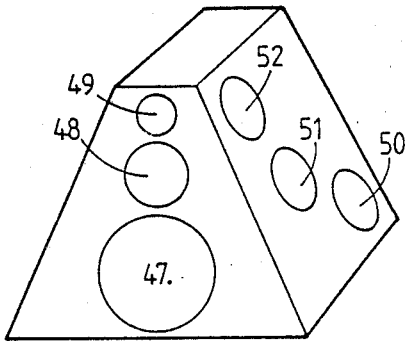
FIG. 14 shows a fifth embodiment of the baffle according to the invention.

Since as shown previously the information relative to the spatial localization is necessary only in a range of frequencies comprised between 300 and 3000 Hz whereas the restitution of the quality of the sound necessitates a range of frequencies going up to about 20.000 Hz, one may obviously separate this information. It is therefore possible to realize an embodiment of the baffle such as shown at FIG. 14 presenting a truncated pyramidal shape having a square or rectangular base, the frontal face of which is provided with loud-speakers 47 for low frequencies (20 to 300 Hz), 48 for the mean frequencies (300 to 3000 Hz) and 49 for the high frequencies (3000 a 30,000 Hz) fed by monosignals. These loud-speakers 47, 48 and 49 are of good quality and they constitute the final element of the high fidelity reproduction chain of the musicality.

Further, this baffle comprises on its lateral faces three couples of loud-speakers 50–51 and 52 tuned as previously seen on frequencies of for example 350 Hz, 600 Hz and 1 KHz. The position of these loud-speakers is such that the wave fronts of the couples are synchronized for the frequencies in a symmetric plan of the baffle. These couples of loud-speakers are fed by stereo signals permitting, as previously seen to send information of Δp and Δt in the whole listening zone which permit the localization of the sounds.

In a variant one can have only one spatiality channel cooperating for the frequencies comprised between 300 and 4.000 Hz with the musical channel to transmit the sound localization information.

Numerous embodiments and variants can be envisaged to obtain the best desired result but it is always necessary, to obtain the desired spatiality, that the disposition of the loud-speakers be such that the couples of right-left loud-speakers be acousticaly coupled, through the inside and/or through the outside of the baffle, for different frequencies comprised between 300 Hz and 1 KHz. Furthermore, one increases further the quality of the restitution if the loud-speakers are located in such a manner that a common wave front is realized in the symmetry plan of the baffle for the sonic waves emitted by the different loud-speaker couples for the different frequencies for which they are coupled.

For the listeners accustomed to a great left-right channel separation such as it is transmitted by the known stereo baffles, particularly when they are not fed through a recording matrix corresponding to the human listening but through a multiple microphone matrix for example, one can provide for a supplementary transducer couple coupled on a frequency of 300 to 1000 Hz and fed by left-right signals in phase opposition. One thus reinforces the effect of channel separation. See FIG. 16, showing one transducer pair fed in phase opposition.

I claim:

1. A monolithic stereophonic baffle, comprising (a) a first group of loud-speakers arranged along a first line and receiving a right signal from an amplifier;

(b) a second group of loud-speakers arranged along a second line at an angle to said first line and receiving a left signal from the amplifier, each loud-speaker of said second group of loud-speakers being associated with one loud-speaker of said first group of loud-speakers;

(c) the right and left signals from the amplifier being in phase;

(d) the path separating the active zones of associated loud-speakers being generally equal to an odd multiple of half of the wavelength of a frequency between 300 and 1000 Hz, thereby creating acoustical coupling for said frequency between said associated loud-speakers;

(e) the coupling frequencies for different associated loud-speakers being different;

(f) the baffle comprising a planar baffle carrying loud-speakers disposed along two lines forming an angle between them, each couple of loud-speakers being connected by a resonance chamber tuned on the coupling frequency of said couple.

2. A baffle as claimed in claim 1, in which at least one of said first and second lines is curved.

3. A monolithic stereophonic baffle, comprising (a) a first group of loud-speakers arranged along a first and receiving a right signal from an amplifier;

(b) a second group of loud-speakers arranged along a second line at an angle to said first line and receiving a left signal from the amplifier, each loud-speaker of said second group of loud-speakers being associated with one loud-speaker of said first group of loud-speakers;

(c) the right and left signals from the amplifier being in phase;

(d) the path separatintg the active zones of associated loud-speakers being generally equal to an odd multiple of half of the wavelength of a frequency between 300 and 1000 Hz, thereby creating acoustical coupling for said frequency between said associated loud-speakers;

(e) the coupling frequencies for different associated loud-speakers being different;

(f) each couple associated loud-speakers being connected by a resonance chamber tuned to the coupling frequency of said couple.

4. A baffle as claimed in claim 3, in which at least one of said first and second lines is curved.

5. A monolithic stereophonic baffle, comprising (a) a first group of loud-speakers arranged along a first line and receiving a right signal from an amplifier;

(b) a second grou of loud-speakers arranged along a second line at an angle to said first line and receiving a left signal from the amplifier, each loud-speaker of said second group of loud-speakers being associated with one loud-speaker of said first group of loud-speakers;

(c) the right and left signals from the amplifier being in phase;

(d) the path separating the active zones of associated loud-speakers being generally equal to an odd multiple of half of the wavelength of a frequency between 300 and 1000 Hz, thereby creating acoustical coupling for said frequency between said associated loud-speakers;

(e) the coupling frequencies for different associated loud-speakers being different;

(f) the signals feeding associated couples of loue-speakers being delayed in time so that the wave fronts which different couples emit are synchronized with one another in the plane of symmetry of the baffle.

6. A baffle as claimed in claim 5, in which at least one of said first and second lines is curved.

7. A monolithic stereophonic baffle, comprising (a) a first group of loud-speakers arranged along a first line and receiving a right signal from an amplifier;

(b) a second group of loud-spealers arranged along a second line at an angle to said first line and receiving a left signal from the amplifier, each loud-speaker of said second group of loud-speakers being associated with one loud-speaker of said first group of loud-speakers;

(c) the right and left signals from the amplifier being in phase;

(d) the path separating the active zones of associated loud-speakers being generally equal to an odd multiple of half of the wavelength of a frequency between 300 and 1000 Hz, thereby creating acoustical coupling for said frequency between said associated loud-speakers;

(e) the coupling frequencies for different associated loud-speakers being different;

(f) and a couple of supplementary loud-speakers coupled to a frequency comprised between 300 and 1000 Hz, these supplementary loud-speakers being fed by left and right signals, respectively, which are in phase opposition.

8. A baffle as claimed in claim 7, in which at least one of said first and second lines is curved.

* * * * *